US008597097B2

(12) United States Patent
Hornik et al.

(10) Patent No.: US 8,597,097 B2
(45) Date of Patent: Dec. 3, 2013

(54) WAGERING GAME WITH COMPUTER PLAYER

(75) Inventors: Jeremy M. Hornik, Chicago, IL (US); Benjamin T. Gomez, Chicago, IL (US); Allon G. Englman, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 3040 days.

(21) Appl. No.: 11/137,071

(22) Filed: May 25, 2005

(65) Prior Publication Data

US 2006/0281526 A1 Dec. 14, 2006

(51) Int. Cl.
*A63F 9/24* (2006.01)

(52) U.S. Cl.
USPC ..... 463/16; 463/17; 463/18; 463/19; 463/20

(58) Field of Classification Search
USPC ..... 463/1–45
See application file for complete search history.

(56) References Cited

U.S. PATENT DOCUMENTS

| | | | | |
|---|---|---|---|---|
| 6,095,920 | A * | 8/2000 | Sadahiro | 463/2 |
| 6,261,177 | B1 * | 7/2001 | Bennett | 463/16 |
| 6,290,600 | B1 * | 9/2001 | Glasson | 463/20 |
| 6,554,704 | B2 * | 4/2003 | Nicastro et al. | 463/20 |
| 6,592,457 | B1 * | 7/2003 | Frohm et al. | 463/16 |
| 6,612,575 | B1 | 9/2003 | Cole et al. | 273/138.1 |
| 6,620,045 | B2 | 9/2003 | Berman et al. | 463/25 |
| 6,669,559 | B1 | 12/2003 | Baerlocher et al. | 463/16 |
| 6,685,560 | B1 | 2/2004 | Hughes | 463/16 |
| 6,743,096 | B2 * | 6/2004 | Allendorf et al. | 463/25 |
| 6,902,478 | B2 | 6/2005 | McClintic | 463/16 |
| 2002/0016200 | A1 * | 2/2002 | Baerlocher et al. | 463/20 |
| 2003/0114219 | A1 | 6/2003 | McClintic | 463/25 |
| 2003/0119581 | A1 * | 6/2003 | Cannon et al. | 463/25 |
| 2003/0125103 | A1 | 7/2003 | Tessmer et al. | 463/20 |
| 2003/0144052 | A1 * | 7/2003 | Walker et al. | 463/20 |
| 2004/0102240 | A1 * | 5/2004 | Gauselmann | 463/20 |
| 2004/0162132 | A1 * | 8/2004 | Jaffe et al. | 463/20 |
| 2005/0054419 | A1 * | 3/2005 | Souza et al. | 463/20 |
| 2005/0143156 | A1 * | 6/2005 | Herrmann et al. | 463/9 |
| 2005/0187008 | A1 * | 8/2005 | Nakajima | 463/20 |

OTHER PUBLICATIONS

Wikipedia, "Sorry! (game)", Mar. 21, 2004, <http://web.archive.org/web/20040321033518/http://en.wikipedia.org/wiki/Sorry!_(game)>.*

PCT International Search Report for International Application No. PCT/US2006/19771 dated Jan. 9, 2007.

Product Sheet for "Keepin' Up With the Joneses™," WMS® Gaming, Inc., 2 pages (date unknown).

Product Sheet for "Party Train™," WMS® Gaming, Inc., 2 pages (date unknown).

* cited by examiner

*Primary Examiner* — Ronald Laneau
*Assistant Examiner* — Justin Myhr
(74) *Attorney, Agent, or Firm* — Nixon Peabody LLP

(57) ABSTRACT

A gaming machine for conducting a wagering game includes a display for displaying a bonus game triggered by a start-bonus outcome and for presenting a plurality of player-selectable elements. Each of the player-selectable elements has a predetermined random outcome associated therewith. A game feature associated with the bonus game is configured to introduce a computer-generated player on the display. The computer-generated player randomly selects at least one player-selectable element from the plurality of player-selectable elements.

20 Claims, 8 Drawing Sheets

WAGERING GAME WITH COMPUTER PLAYER

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a wagering game having a computer player.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

Improvements in entertainment value may yet be realized by enhancing the gaming machine's interaction with the player during a bonus game, or the like.

SUMMARY OF THE INVENTION

According to one aspect of the present concepts, a gaming machine for conducting a wagering game is provide which includes a display for displaying a bonus game triggered by a start-bonus outcome and for presenting a plurality of player-selectable elements. Each of the player-selectable elements has a predetermined random outcome associated therewith. A game feature associated with the bonus game is configured to introduce a computer-generated player on the display. The computer-generated player randomly selects at least one player-selectable element from the plurality of player-selectable elements.

In another aspect of the presently disclosed concepts, a gaming machine is provided which includes a display for displaying a game associated with a wagering game, triggered by a start-game outcome, and for presenting a plurality of player-selectable elements. Each of the player-selectable elements has a predetermined random outcome associated therewith. A game feature is also associated with the game. The game feature is configured to introduce a computer-generated player on the display to randomly select at least one player-selectable element from the plurality of player-selectable elements.

In yet another aspect, a method of conducting a wagering game on a gaming machine is provide which includes the step of displaying a plurality of player-selectable elements, each of the player-selectable elements having a predetermined random outcome associated therewith. The method also includes the steps of receiving a player selection from the plurality of player-selectable elements and receiving a computer-player selection from the plurality of plurality of player-selectable elements. The method further includes the step of determining an award to the player based on the player selection and computer-player selection.

According to another aspect of the present concepts, a method of conducting a wagering game on a gaming machine is provided which includes the step of displaying a plurality of player-selectable elements, each of which masks an associated outcome, wherein one of the outcomes is a start-computer-player outcome. Other steps include receiving player selections from the plurality of player selectable elements and, in response to the start-computer-player outcome being selected by the player, introducing a computer player. Further steps include receiving computer-player selections from the plurality of plurality selectable elements and, in response to the start-computer-player outcome not being selected during the wagering game, awarding the player an award based on the player selections. The method also includes the step of awarding the player an award based on the player selections and the receiving computer-player selections in response to the start-computer-player outcome being selected during the wagering game.

Additional aspects of the present concepts will be apparent to those of ordinary skill in the art in view of the detailed description of various embodiments, which is made with reference to the drawings, a brief description of which is provided below.

DETAILED DESCRIPTION

Figure 1:
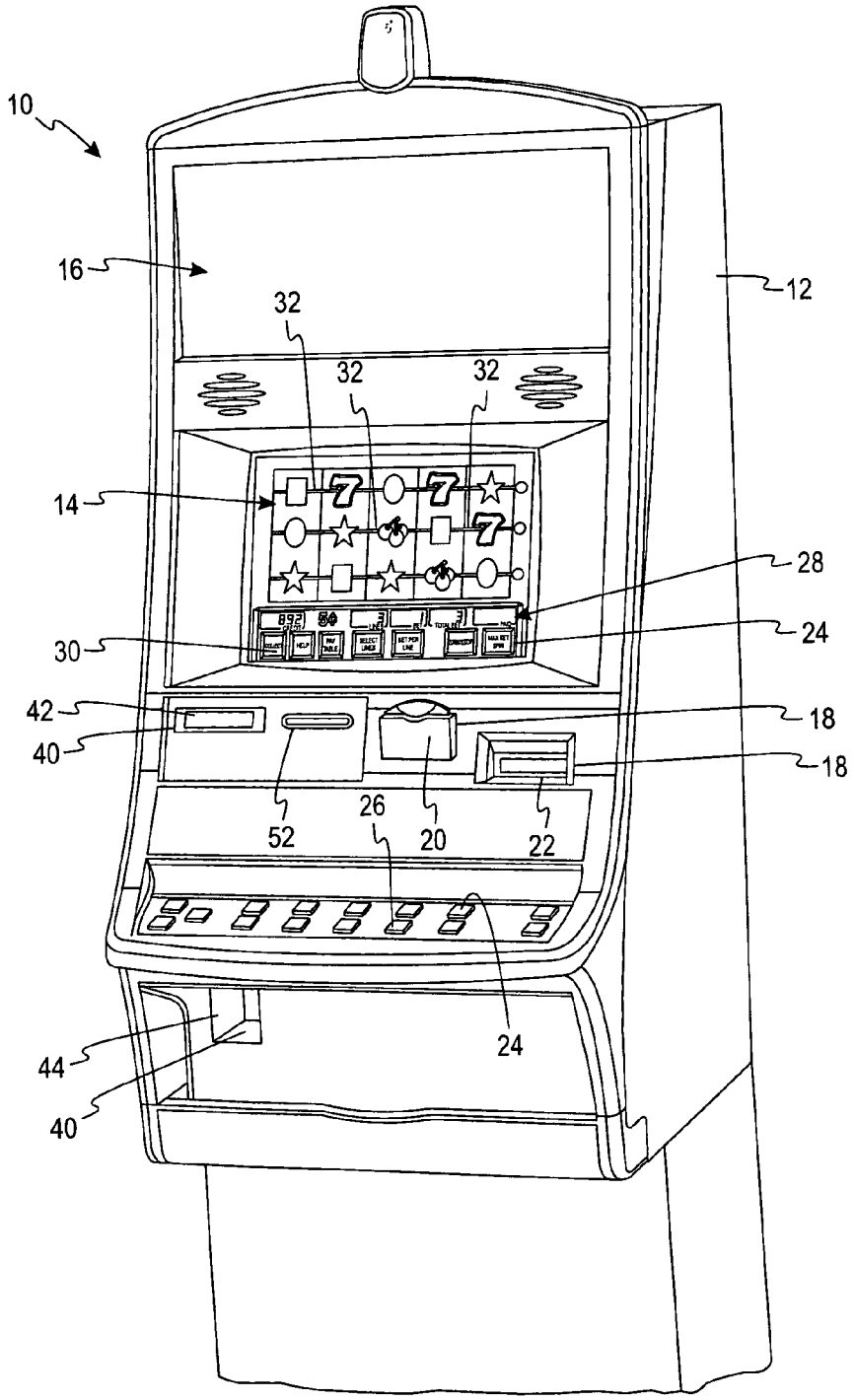
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. Primary display 14 can also display information about a bonus wagering game and a progressive wagering game. Gaming machine 10 may also include a secondary display 16 for displaying game events, game outcomes, and/or signage information. While these typical components found in gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual associated to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
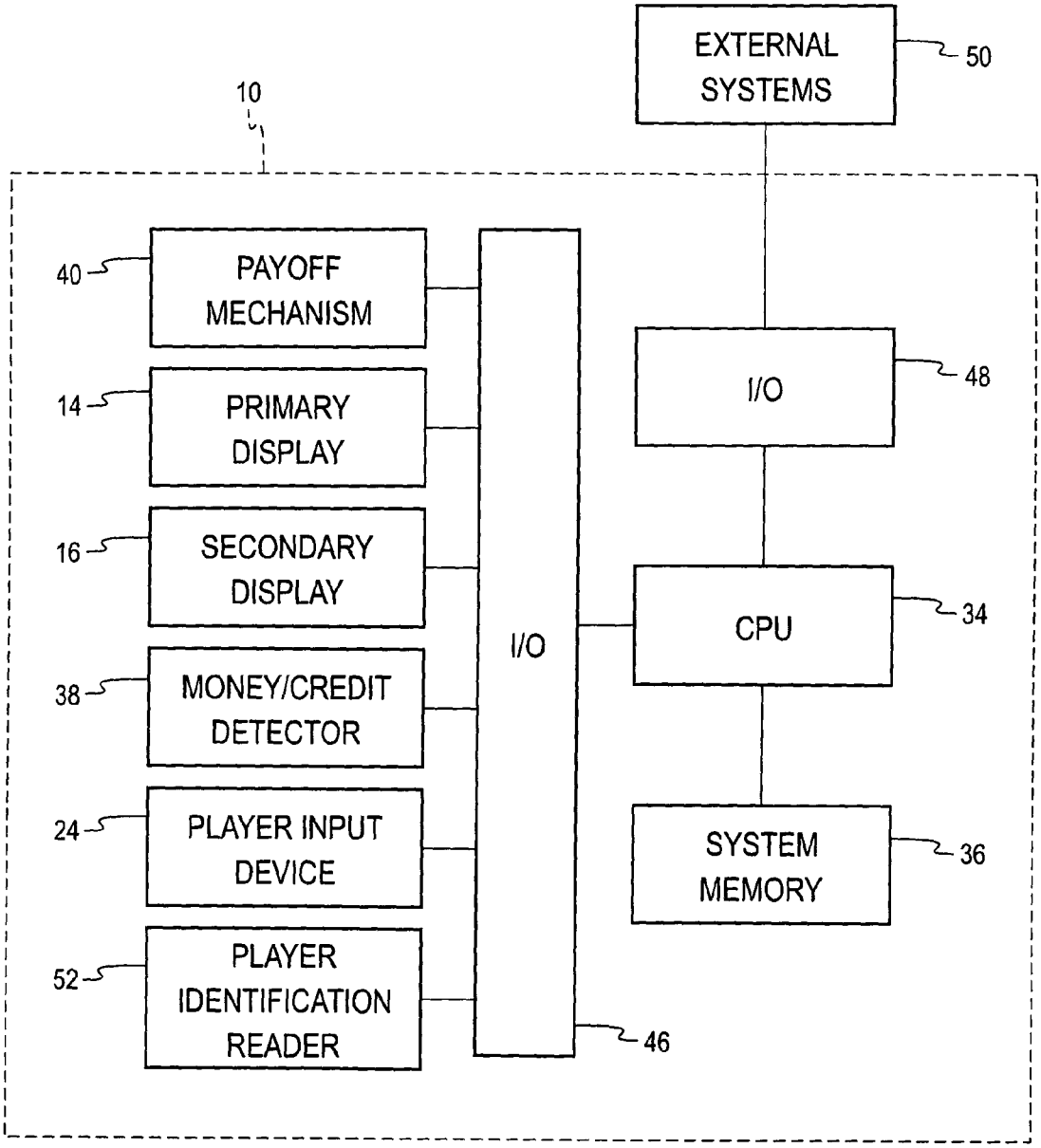
FIG. 2 is a block diagram of a control system suitable for operating the gaming machine.
Figure 3A:
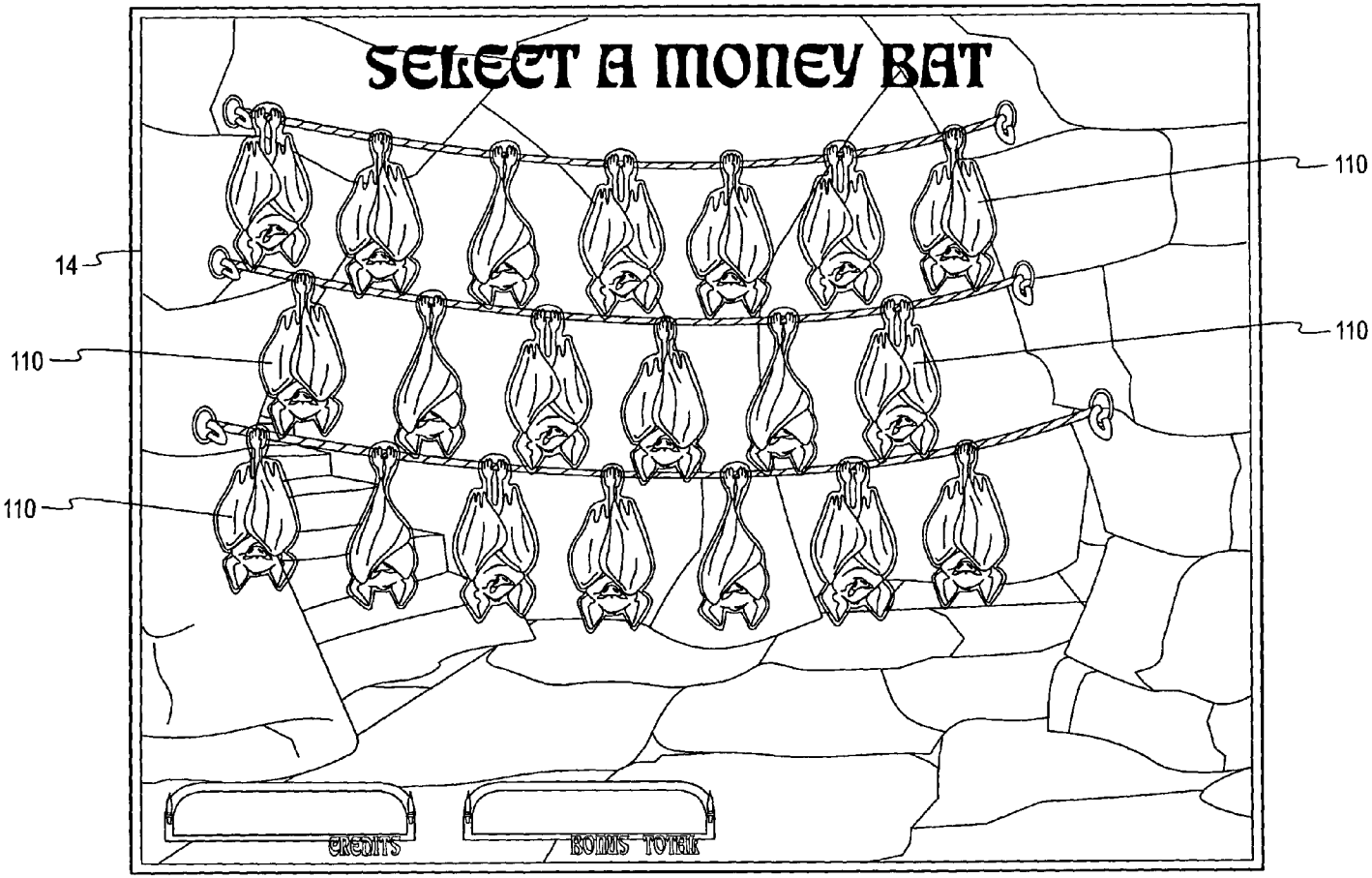
FIGS. 3(*a*)-3(*e*) show various screen-shots of an example of a bonus game in accord with the present concepts.
Figure 3B:
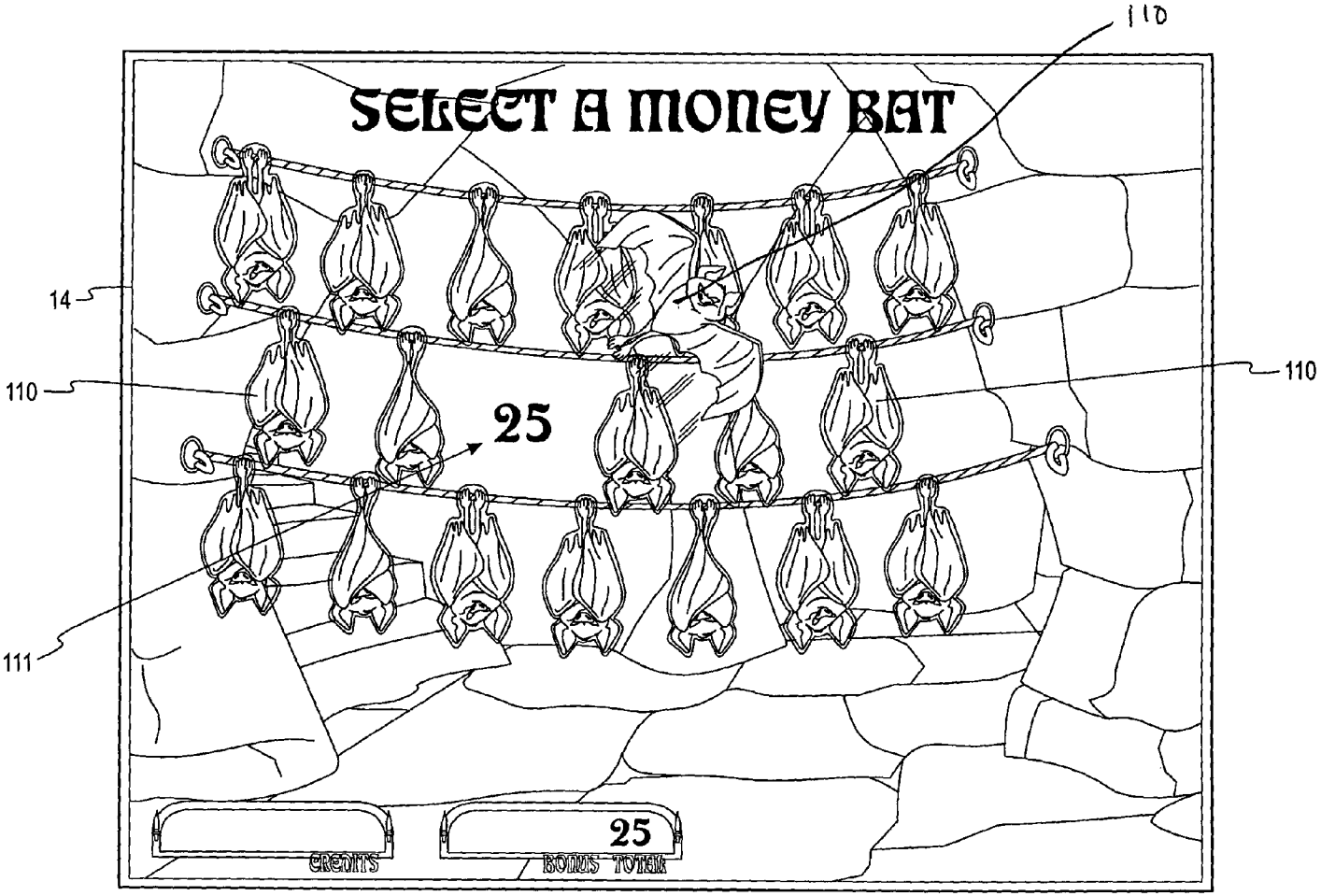
Figure 3C:
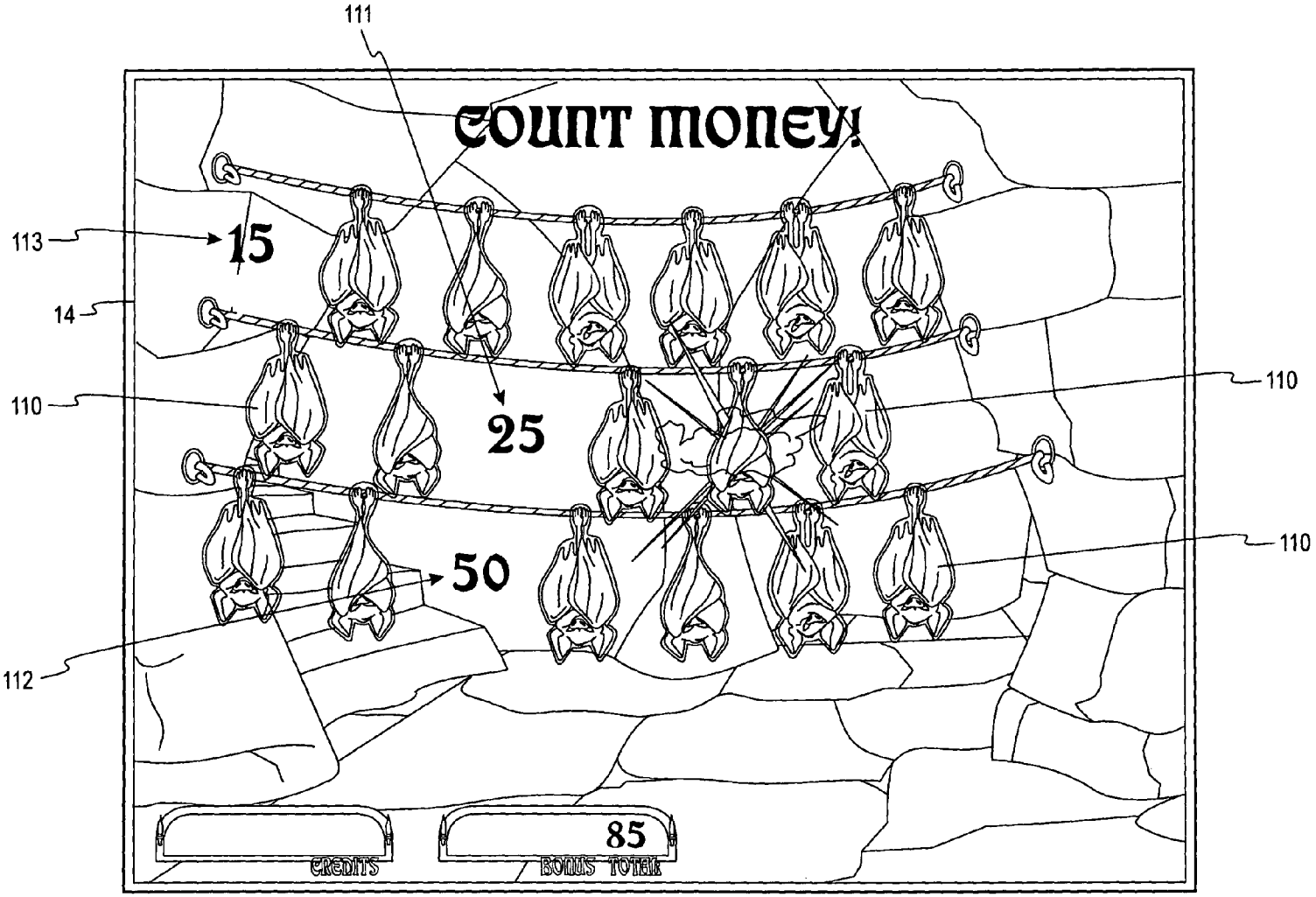
Figure 3D:
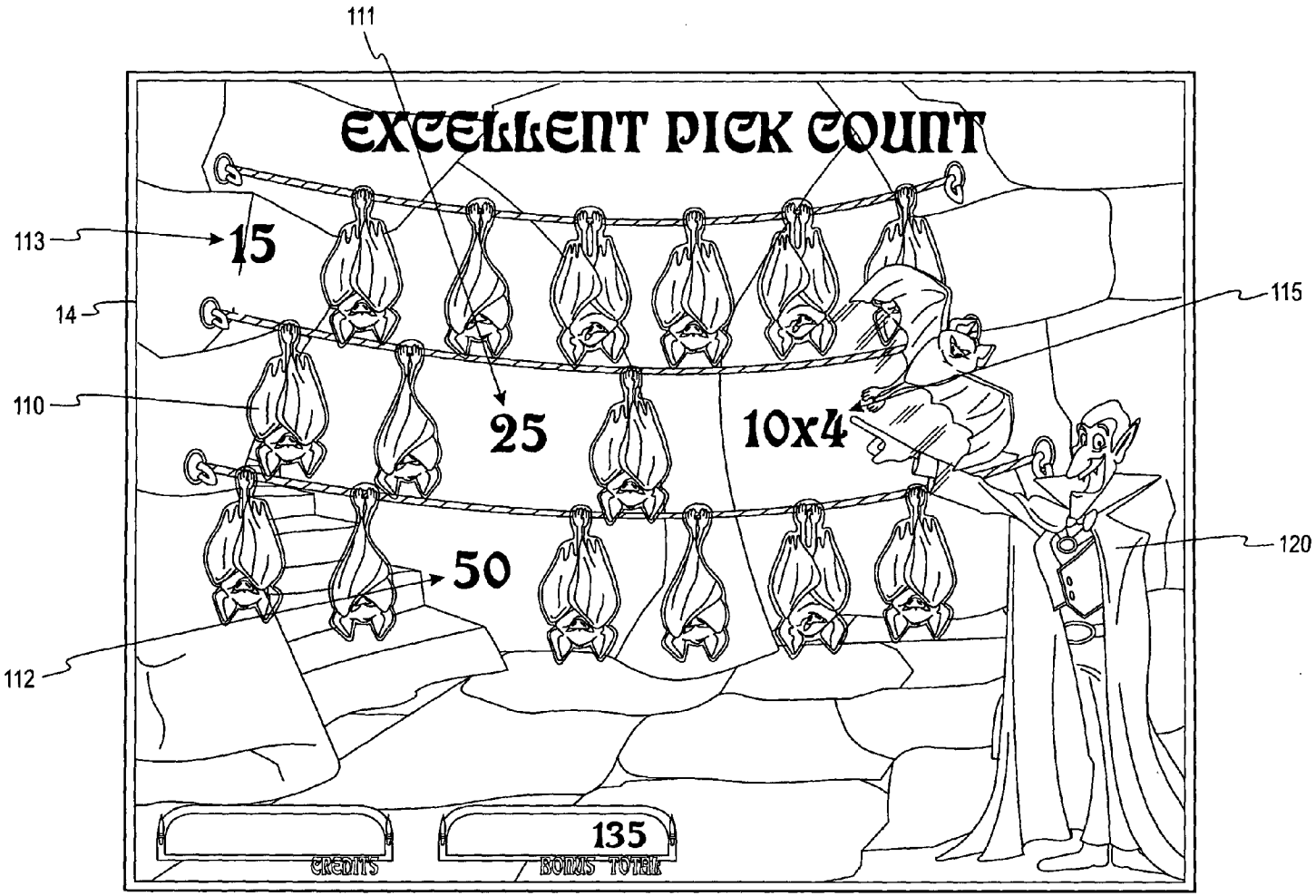
Figure 3E:
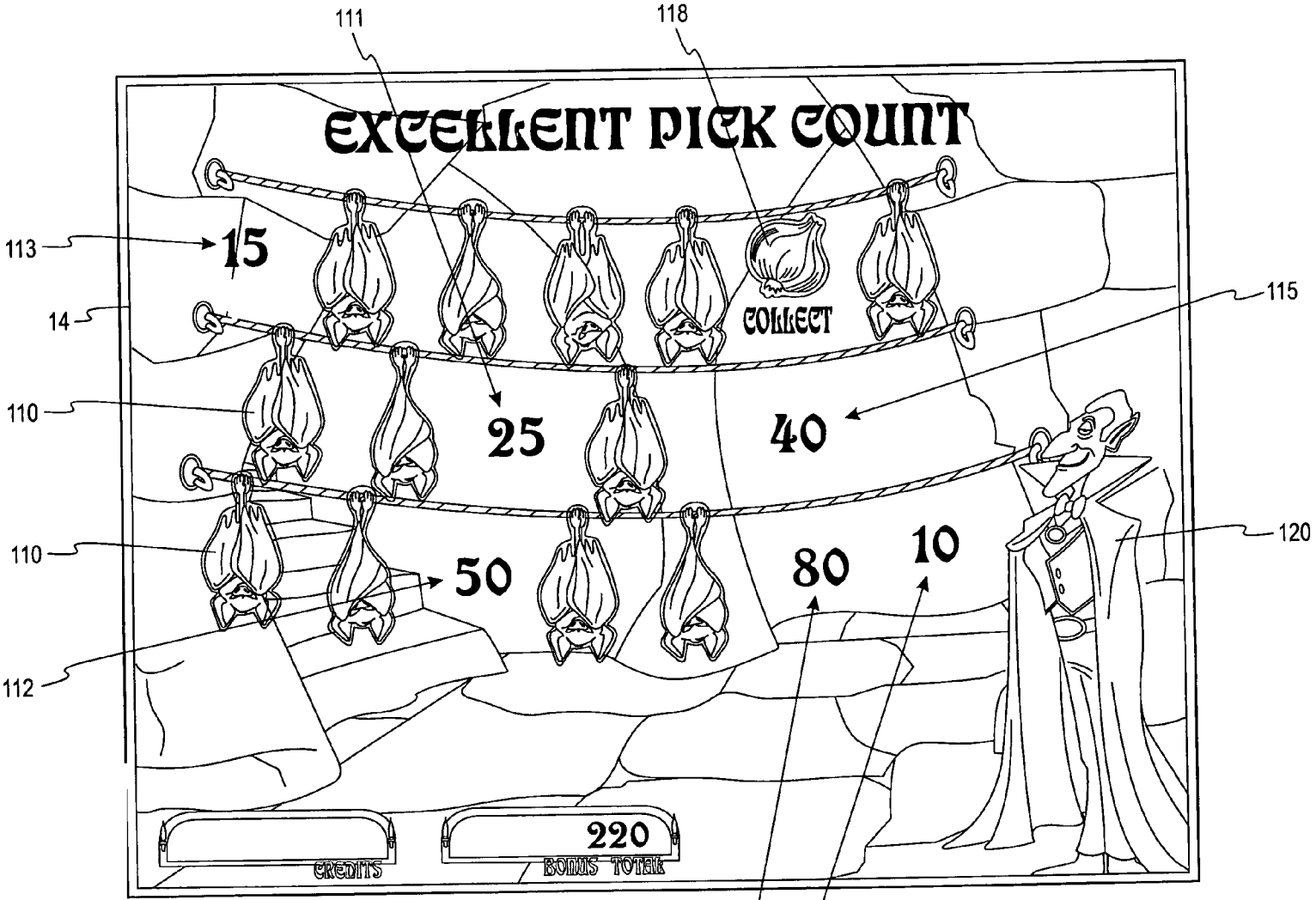

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game.

Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Turning now to FIGS. 3(*a*)-(*e*), these figures show various screen-shots of one exemplary bonus game implemented on gaming machine (e.g., 10) illustrating aspects of the present concepts. The bonus game may be triggered by any desired start-bonus outcome event or combination of start-bonus outcome events. For example, the start-bonus outcome event could comprise the occurrence of a particular event in the basic wagering game, a conventional example of which includes the display of a particular symbol or a sequential or scattered combination of symbols displayed along a payline.

In FIGS. 3(*a*)-(*e*), a plurality of selectable elements 110 are shown on the display, such as primary display 14 and/or secondary display 16. The selectable elements 110 may be arranged in any manner, random or ordered, and may comprise, for example, an array (n×n or n×m, wherein n and m are integers) of elements, an ordered grouping of elements having one or more levels or rows which may be equal in size or which may vary in size, a plurality of separate ordered groupings of elements, or a scattered arrangement of elements. In the example of FIGS. 3(*a*)-3(*e*), the selectable elements 110 are arranged in an ordered grouping of three rows with seven positions in each of the top and bottom rows and six positions in the middle row.

The selectable elements 110 in FIGS. 3(*a*)-(*e*) are bats so to correspond with the theme of the depicted bonus game. Generally, the selectable elements 110 are presented in a manner corresponding to an underlying theme of the bonus game with which they are associated and the selectable elements may be freely varied or adapted to suit any particular theme, purpose, or desired visual-effect. For example, in a wagering game having a gold-rush or gold-prospecting theme, the selectable elements 110 could each be represented by a small parcel of land defined within a larger territory. Each of the selectable elements 110 has a predetermined random outcome associated therewith that is revealed to the player following selection thereof (i.e., following immediately or after some predetermined time or following the subsequent occurrence or lapse of a condition) and is subsequently removed from the plurality of selectable elements. The predetermined random outcome associated with each of the selectable elements 110 might include, for example, a fixed monetary value, a tangible benefit (e.g., an extra pick, a defense against an "end-game" outcome, an elevation to a higher level of awards in subsequent turns, etc.), a multiplier of an accumulated bonus game award, a tangible detriment (e.g., an "end-game" outcome, a loss of all or part of an accumulated bonus game award, a demotion to a lower level of awards in subsequent turns, etc.), or as later described, a "start-game feature" outcome which introduces a computer-generated player.

In the aspect of the present concepts represented by FIG. 3(*b*), the player is shown to have selected a selectable element 110 (e.g., a bat) in the middle row of selectable elements, third position from the left to reveal a predetermined random outcome 111 of 25 credits. The reveal is shown to be accomplished, in FIG. 3(*a*), by the selected selectable element 110, a bat, flying away. However, the graphics associated with the reveal may assume any form and/or sequence. In various examples in accord with the illustrated theme and selectable elements 110, the bat may simply vanish, vanish with an attendant visual effect, or use another form of locomotion to move off-screen. The removal of the selectable element 110 from the available plurality of selectable elements might also be accomplished in other manners, such as in a change of state of the selectable element from a first state to a second state, whereupon the second state may be randomly selected from a plurality of states. The selectable element 110 therefore does not actually have to disappear from the displayed screen, but may remain in a distinctive, functionally-inert form. The manner of the reveal may thus be used to vary and enhance the entertainment value of the bonus game play.

Although the example of the present concepts illustrated in FIGS. 3(*a*)-3(*e*) show that the selectable elements 110 are replaced by the indicated predetermined random outcome, the bonus game is not limited to this stylistic presentation. In other non-limiting embodiments, the selectable element 110, following selection, may be replaced by the another non-selectable element, such as a blank space, or optionally by yet another tier or type of selectable element, which may or may not be visually distinct from the initially selected selectable element. Thus, a black bat might be replaced by a silver bat, which may optionally be associated with both a higher award value and a higher risk of an "end-game" outcome than the initial tier of black bats. A silver bat might be replaced by a gold bat with still higher risk/reward consequences, and so on.

FIG. 3(*c*) likewise shows a player has previously selected a selectable element 110 in the bottom row, third position from the left to reveal a predetermined random outcome 112 of 50 credits and a selectable element in the top row, left-most position to reveal a predetermined random outcome 113 of 15 credits. In the turn represented in FIG. 3(*c*), the player is selecting a selectable element 110 in the middle row, second position from the right to reveal the predetermined random outcome associated therewith. In this instance, the predetermined random outcome is a "start-game feature" outcome which initiates a game feature associated with the bonus game. The start-game-feature outcome may be randomly associated with one of the selectable elements 110 or, in another aspect of the present concepts, may be randomly assigned to a plurality of selectable elements 110.

In accord with the start-game feature outcome, a computer-generated player is introduced. FIG. 3(*c*) shows, at the top of the screen, the optional heralding of the arrival of the computer-generated player 120 following the player's selection of the selected selectable element 110 associated with the start-game feature. In the example shown, the "start-game feature" outcome selected by the player introduces "Count Money" 120 to the bonus game, as discussed below.

As shown in FIG. 3(*d*), the computer-generated player 120 (e.g., Count Money) is configured to randomly select at least one selectable element 110 from the plurality of selectable elements. In one aspect, the computer-generated player 120, here Count Money, may alternate turns with the player or may be configured to play in a sequence other than singular, alternating turns with the player. In another aspect in accord with the present concepts, the computer-generated player 120 may be configured with a predetermined maximum number of turns, after which number of turns the computer-generated player 120 no longer participates in the selection of selectable elements 110. Thus, the computer-generated player 120 may be optionally and arbitrarily limited to one turn, two turns, three turns, etc., rather than conditioning the end of the computer-generated players' play on an "end-game" outcome which ends the bonus game. Otherwise, the computer-generated player 120 may continue game play with or against the player until the bonus game is concluded by an end-game outcome which may be, in one aspect, randomly associated with one or more selectable elements 110. The bonus game would thus end when, for example, a selectable element 110 randomly assigned an end-game outcome is selected by the player or by the computer-generated player 120 or, alternatively, when both the player and the computer-generated player 120 select a selectable element 110 randomly assigned with an end-game outcome (once a computer-generated player has been activated).

FIG. 3(*d*) shows one potential static representation of the computer-generated player 120 denoted as "Count Money." Count Money is configured to randomly select at least one selectable element 110 from the plurality of selectable elements. In one aspect of bonus game play, the bonus game is configured to permit a player and the computer-generated player 120, such as Count Money, to alternately select a selectable element 110 from the available plurality of selectable elements until a predetermined end-game outcome is realized. As noted above, the end-game outcome might occur based upon a singular condition, such as the player selecting a selectable element 110 randomly associated with an end-game outcome, or a plural condition, such as each of the player and the computer-generated player 120 selecting a selectable element 110 randomly associated with an end-game outcome. In the latter case, for example, even after the player has effectively ended his or her own play in the bonus game, if they were fortunate enough to have activated the game feature to introduce the computer-generated player 120, the computer-generated player may play on and continue to benefit the player for a cooperatively configured game feature until it too selects a selectable element 110 randomly associated with an end-game outcome.

Turning once again to FIG. 3(*d*), it can be seen that, in the turn following that shown in FIG. 3(*c*), Count Money has selected the selectable element 110 in the middle row, right-most position to reveal a predetermined random outcome 115 of 10 credits. In this case, however, the predetermined random outcome 115 of 10 credits is multiplied by four times for a total value of 40 credits. FIG. 3(*e*) shows the bonus game play after a few more turns. FIG. 3(*e*) shows that the player has selected the selectable element 110 in the bottom row, right-most position to reveal a predetermined random outcome 116 of 10 credits. The computer-generated player 120 then selected a selectable element in the bottom row to reveal a predetermined random outcome of 20 credits, which is multiplied by 4×, in this instance, to attain a final award 117 of 80 credits, as indicated. In the turn represented by FIG. 3(*e*), the player then selects a selectable element 110 having a predetermined random outcome 118 associated with an "end-game" outcome, represented thematically in this particular example as a clove of garlic. As previously noted, one aspect of the present concepts would end the bonus game upon this selection of a selectable element 110 randomly assigned with an end-game outcome, whereas other aspects of the present concepts would end the player's play in the bonus game, but would permit the computer-generated player 120 (e.g., Count Money) to continue selecting selectable elements until the computer-generated player 120 also selects a selectable element randomly assigned with an end-game outcome.

Thus, in one example of the present concepts, a gaming machine bonus game includes a game feature initiated by a start-game-feature outcome that is randomly assigned to at least one of the plurality of selectable elements 110. An end-game outcome is also randomly assigned to at least one of the plurality of selectable elements 110. Each of the start-game-feature and end-game outcomes is activated by a selection of a selectable element 10 randomly assigned or associated with such outcome by the player and/or the computer-generated player 120. The player and the computer-generated player 120 alternately select selectable elements 110 from the plurality of selectable elements until the player and/or the computer-generated player 120 select a selectable element assigned or associated with an end-game outcome. In this example, the predetermined random outcomes arising from the computer-generated player's 120 random selection of selectable element(s) 110 is transferred to a player's accumulated award in the bonus game.

In the example of FIGS. 3(*a*)-3(*e*), the computer-generated player 120 (e.g., Count Money) is shown to work cooperatively with the player to enhance the player's winnings. For example, the predetermined random outcome arising from Count Money's 120 random selection of a selectable element 110 from the plurality of selectable elements or a multiple thereof (e.g., 1.5×, 2×, 3×, 4×, 5×, etc.) is transferred to a player's gaming account or is otherwise credited or provided to the player or transferred to an account designated by the player by conventional payout and/or electronic transfer and/or electronic writing device.

Alternatively, the computer-generated player 120, which may be Count Money or some other computer-generated player in this or in another game, may be configured to work competitively against the player. In a competitive-play situation, the computer-generated player's 120 outcome, or possibly even a multiple thereof, is transferred to the computer-generated player's 120 "account". The player and the computer-generated player 120 continue to play against each other until a pre-determined end-outcome condition has been satisfied. In one aspect of the competitive-play situation, the players award is determined by comparing the player's accumulated total award to that of the accumulated value in the computer-generated player's 120 account. So long as the player's accumulated total is greater than that of the computer-generated player's 120, the player gets to keep his or her accumulated total award. In an optional winner-take-all aspect thereof, the player may be awarded the accumulated value in the computer-generated player's 120 account.

A transfer outcome may optionally be incorporated into the game feature itself, with one or more selectable elements 110 being randomly associated with a transfer outcome. The transfer outcome could comprise a function wherein a predetermined or randomly-selected number of the player's prior outcomes and/or subsequent outcomes are transferred to the computer generated player's 120 account, or vice versa. For example, one transfer outcome could dictate that the player's next selection goes to the computer generated player 120. In another example, the transfer outcome could dictate that the player's last outcome and the player's next outcome be transferred to the computer generated player 120. In still another example, the transfer outcome could cause the entire accumulated total award in a player's bonus game accumulator to be transferred to the computer-generated player 120, or vice versa. The extent are variably of the transfer function is open and may comprise any function which transfers any outcome, monetary or otherwise, from the player to the computer generated player 120, or vice versa. Thus, the optional transfer outcome may be two-way, providing both a potential benefit and detriment to the player, or may be only one-way, so as to only confer a potential benefit to the player.

In another aspect of the present concepts, a plurality of such computer-generated players 120 may be randomly associated with a corresponding plurality of selectable elements 110 and each of these computer-generated players may be endowed with or configured to generate and/or influence certain events or outcomes in the bonus game. In such an aspect, the plurality of such computer-generated players 120 could be exclusively aligned with co-operative play mode or a competitive play mode or, alternatively, both modes could be simultaneously present. Each computer-generated players 120 would preferably, but not necessarily, differ in appearance and/or function. For example, a first computer-generated player 120 may provide a doubled payout for a selected one of the selectable elements 110, a second computer-generated player 120 may provide a tripled payout for a selected one of the selectable elements 110, and so on. One computer-generated player 120 may be configured to double a player's existing accumulated award in the game award accumulator, while yet another computer-generated player may be configured to empty a player's existing accumulated award, while still permitting the player to continue play. Thus, elements of both cooperative and competitive play may be simultaneously present. The computer-generated players 120 may remain in play for a predetermined time, a predetermined number of turns, attainment of a predetermined minimum award, or until satisfaction of a predetermined event, such as fulfillment of a pre-determined function (e.g., doubling a player's accumulated award) or as by selection of a selectable element associated with an end-game outcome.

Figure 4:
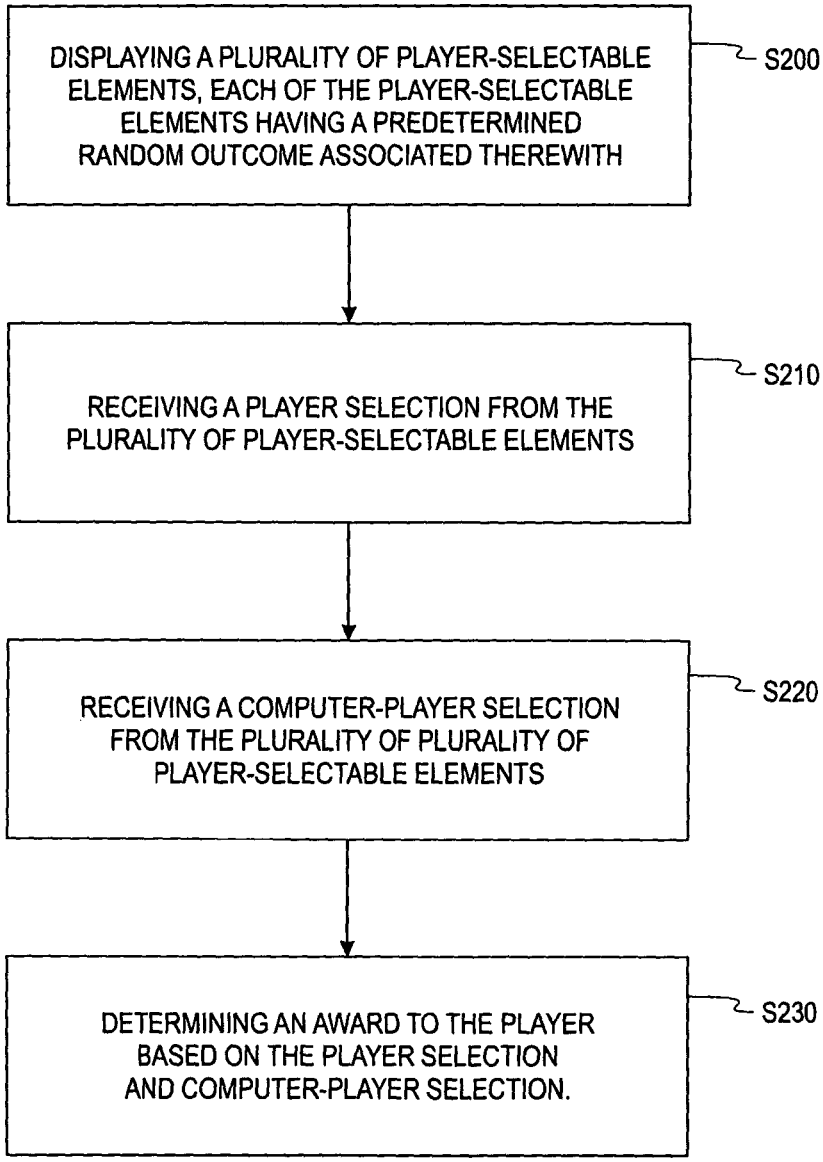
FIG. 4 shows a flow-chart for an example of a bonus game method in accord with the present concepts.

In another aspect of the present concepts, shown generally in FIG. 4, a method of conducting a wagering game on a gaming machine generally includes the steps of displaying a plurality of player-selectable elements, each of which has a predetermined random outcome associated therewith (step S200), and receiving a player selection from the plurality of player selectable elements (step S210). The method also includes the step of receiving a computer-player selection from the plurality of plurality selectable elements (step S220). Based on the player selection and computer-player selection in steps S210 and S220, an award to the player is determined in step 230. These steps may optionally be performed in combination with any single step or combination of steps described hereinafter.

In one embodiment, selecting steps S210-S220 may further comprise an alternating selection protocol wherein the player and the computer-generated player 120 alternately select a selectable element 110 from the plurality of player-selectable elements. In other aspects, selecting steps S210-S220 may also include other selection protocols wherein the selection of the player or the computer-generated player 120 does not alternate, on a one-to-one basis, with the selection of the other one of the player or the computer-generated player.

Although not shown in FIG. 4, the method of conducting a wagering game may include, in response to or following each selecting step S210-S220, the step of revealing the outcomes associated with the player selection and the computer-generated player 120 selection (step S240). In various aspects, the aforementioned method may include the steps of randomly associating one or more selectable elements 110 with an end-game outcome (step S250) and/or a start-game feature outcome (step S260), configured to introduce another computer-generated player to the bonus game. The method may also include the step of conditioning an end of the bonus game on the selection of a selectable element 110 associated with an end-bonus game outcome by the player or by the computer generated player (step S270). Alternatively, the method may condition an end of the bonus game on the selection of a selectable element associated with an end-bonus game outcome by each of the player and the computer generated player (step S280).

Other steps in the method may include assigning to a player a predetermined random outcome arising from the computer-generated player's 120 outcome (step S290) and, further thereto, the step of randomly assigning a transfer outcome to one or more player-selectable elements (step S292). Additionally, following step S292 and in response to the player selection being the transfer outcome, the method could include transferring a player's accumulated award to a computer-generated player 110 or transferring a computer-generated player's accumulated award to the player (step 294). The transfer outcome may be adapted to transfer one or more prior awards or outcomes, or subsequent awards or outcomes, to the other (or another) party. The method may also include the step of multiplying the computer-generated player's selection by a multiplier (step S300).

The introduction of the computer-generated player 120 to the display may itself comprise, in a step S310, displaying effects including any combination of an icon, an animation, a textual message, a picture, a graphic, an image, and an action taken by the computer-generated player. The latter characteristic might include, for example, instances where the computer-generated player 120 is not visible on the screen, but the effects of the computer-generated player's actions are displayed on the screen. In such case, the computer-generated player 120 might comprise a ghost or other disembodied presence. Thus, the use of an image or other visible representation of the computer-generated player is optional and is not necessary in accord with the present concepts. Such effects may also include aspects which precede or follow the introduction of the computer-generated player 120.

A computer readable storage medium may likewise be encoded with instructions for, upon execution by a processor, directing a gaming device to perform a method comprising the steps of defining a plurality of selectable elements 110 in a bonus game, each of the selectable elements having a predetermined random outcome associated therewith, selecting a selectable element from the plurality of selectable elements, introducing a computer-generated player 120 to the bonus game in response to a start-computer generated player outcome, and enabling the computer-generated player to perform at least one selecting step. The computer readable storage medium may further be encoded with instructions for directing a gaming device to perform any single step or any combination of additional steps including, but not limited to, the steps described above.

The selection feature has been defined relative to a bonus game. However, the selection feature with the computer-generated character can be used in other wagering games including, but not limited to, a basic wagering game or a progressive wagering game. For example, during the play of a basic wagering game, a player could be directed to an alternate screen wherein the player and a computer-generated player 120, if activated by a start-game-feature outcome, play cooperatively or competitively to influence an outcome in the basic wagering game itself. Following termination of such alternate screen, the player would be returned to the basic wagering game in-progress, which is influenced by the game play in the alternate screen.

Still further, the present concepts do not require that the start-game-feature outcome which introduces the computer generated player 120 be associated with a selection of a selectable element by the player. Instead, it is possible for the start-game-feature outcome to be associated with one or more particular outcomes in the basic game. For example, in a 5-reel video terminal, the bonus game may be enabled by the occurrence of a particular symbol on three adjacent reels along an active payline. The start-game-feature outcome which introduces the computer generated player 120 may be optionally linked to the symbol or symbols on the remaining reels. In one example, a symbol associated with the start-game-feature outcome may bear the likeness of a computer-generated player. In an aspect wherein the computer generated player 120 may be associated with a basic wagering game, as opposed to a bonus game, the occurrence of a symbol linked with the start-game-feature outcome along an active payline, two such symbols scattered about active paylines, or some other combination, could itself be sufficient to direct the player to another screen associated with the basic wagering game. The timing of the introduction of the computer generated player 120 could further be influenced by various combinations of symbols along active paylines in the basic wagering game. For example, one combination of symbols along active paylines in the basic wagering game could dictate the immediate introduction of the computer generated player 120, whereas another combination of symbols could retard the introduction of the computer generated player for one or more turns.

Each of these embodiments and obvious variations thereof is contemplated as falling within the spirit and scope of the claimed invention, which is set forth in the following claims. For example, each of the aforementioned and hereinafter claimed method steps may be combined in various sequences and/or combinations not explicitly recited herein.

The present concepts may also be adapted to import one or more virtual players from other linked gaming terminal(s) wherein the above-described functions of the computer-generated player are performed by one or more other linked players who control various turns of the computer-generated player, such other players optionally being benefited by or compensated for their participation. For example, such other player could operate the computer-generated player in an adversarial mode and potentially obtain and retain awards associated with the selectable elements 110 selected by the player through the computer-generated player.

The present concepts may also include incorporating the computer-generated player 120 concept into the basic wagering game itself. Thus, a computer-generated player 120 could be introduced into a free-spin environment where the player might get awarded all left-to-right pays, the computer-generated player gets all right-to-left pays, and a certain symbol combination transfers the computer-generated player's award to the player. In one aspect, this importation of the computer-generated player 120 into the basic wagering game might stem from a selectable element 110 in a bonus game, or the like, which provides a "latent" effect wherein the computer-generated player influences the basic wagering game in some manner (e.g., providing additional award opportunities in a subsequent basic wagering game). An example of such a latent effect could include a "latent" transfer function wherein, as noted above, an award associated with a reel symbols or combination of reel symbols in a designated position or positions (e.g., along a payline) thereof are attributed to the computer-generated player and are then transferred to the player. Such latent effect may itself be generally applied not only in the context of the present invention, but to any bonus game and subsequently played wagering game, whether having computer-generated players or not. In the noted aspect, the computer-generated player may optionally remain on-screen in some capacity to inform or remind the player of such continuing influence of the computer-generated player 120 and to entertain the player. In one aspect, the computer-generated player 120 could remain substantially stationary or move about the display 14 such as above, below, beside, or even behind the reels. The computer-generated player 120 could also perform acts and movements selected from a large number of possible acts and movements consistent with the game theme and the computer-generated player's persona to enhance the entertainment value thereof.

What is claimed is:

1. A gaming machine comprising:

a display for displaying a bonus game, triggered by a start-bonus outcome, and presenting a plurality of player-selectable elements, each of the player-selectable elements having a predetermined random outcome associated therewith, at least one of the predetermined random outcomes comprising a start-game-feature outcome; and a game feature associated with the bonus game, the game feature being initiated by player selection of at least one player-selectable element with the start-game-feature outcome associated therewith, wherein initiation of the game feature introduces a computer-generated player on the display to randomly select at least one player-selectable element from the plurality of player-selectable elements.

2. The gaming machine of claim 1, wherein the computer-generated player is configured with a predetermined maximum number of selections, after which number of selections the computer-generated player no longer selects from the plurality of player-selectable elements.

3. The gaming machine of claim 1, wherein initiation of the game feature also introduces a second computer-generated player on the display to randomly select at least one player-selectable element from the plurality of player-selectable elements, the computer-generated player working cooperatively with the player and the second computer-generated player working competitively against the player.

4. The gaming machine of claim 1, wherein the bonus game is ended by an end-game outcome, wherein the end-game outcome is randomly assigned to at least one of the plurality of selectable elements, and wherein the end-game outcome is activated by selection of the at least one selectable element randomly assigned the end-game outcome by at least one of a player and the computer-generated player.

5. The gaming machine of claim 1, wherein the bonus game is configured to permit a player and the computer-generated player to alternately select a selectable element from the plurality of selectable elements.

6. The gaming machine of claim 1, wherein at least one of the predetermined random outcomes arising from the computer-generated player's random selection of a selectable element from the plurality of selectable elements and a multiple thereof is transferred to a player.

7. The gaming machine of claim 1, wherein the computer-generated player assumes an adversarial role relative to the player in a competitive play mode.

8. The gaming machine of claim 7, wherein the predetermined random outcome associated with each of the selectable elements randomly selected by the computer-generated player is accumulated in an accumulator, and wherein the accumulator contents are transferred to a player upon the player's selection of a selectable element assigned a transfer outcome.

9. A gaming machine comprising:

a display for displaying a game associated with a wagering game, triggered by a start-game outcome, and presenting a plurality of player-selectable elements, each of the player-selectable elements having a predetermined random outcome associated therewith, at least one of the predetermined random outcomes comprising a start-game-feature outcome; and a game feature associated with the game, the game feature being initiated by player selection of at least one player-selectable element with the start-game-feature outcome associated therewith, wherein initiation of the game feature introduces a computer-generated player on the display to randomly select at least one player-selectable element from the plurality of player-selectable elements.

10. A method of conducting a wagering game on a gaming machine including a display and a wager input device, the method comprising:

receiving a wager from a player via the wager input device;

displaying a plurality of player-selectable elements via the display, each of the player-selectable elements having a predetermined random outcome associated therewith, at least one of the predetermined random outcomes comprising a start-computer-player outcome;

receiving a player selection from the plurality of player-selectable elements;

receiving a randomly determined computer-player selection from the plurality of player-selectable elements in response to the start-computer-player outcome being selected by the player; and determining an award to the player based on the player selection and computer-player selection.

11. The method of claim 10, further comprising the step of:

revealing the outcomes associated with the player selection and the computer-player selection.

12. The method of claim 10, further comprising the step of:

randomly associating at least one of said plurality of selectable elements with an end-game outcome.

13. The method of claim 10, further comprising the step of:

conditioning an end of the bonus game on selection of a selectable element associated with an end-bonus game predetermined random outcome by either one of the player and the computer-generated player.

14. The method of claim 10, further comprising the step of:

conditioning an end of the bonus game on selection of a selectable element associated with an end-bonus game predetermined random outcome by the player and by the computer-generated player, wherein computer-player selections continue until either the computer-generated player or both the player and the computer-generated player select a selectable element with an end-game outcome associated therewith.

15. The method of claim 10, further comprising the step of:

assigning to a player a predetermined random outcome arising from the computer-generated player selection.

16. The method of claim 10, further comprising the steps of:

randomly assigning a transfer outcome to at least one player-selectable element; and in response to the player selection being the transfer outcome, performing one of transferring of a player's accumulated award to a computer-generated player and transferring of a computer-generated player's accumulated award to the player.

17. The method of claim 10, further comprising the step of:

randomly assigning a transfer outcome to at least one player-selectable element; and in response to the computer-generated player's selection being the transfer outcome, performing one of transferring of a player's accumulated award to a computer-generated player and transferring of a computer-generated player's accumulated award to the player.

18. The method of claim 10, further comprising the step of:

multiplying the outcome of the computer-generated player's selection by a multiplier.

19. The method of claim 10, further comprising the step of:

displaying at least one of an icon, an animation, a textual message, a picture, a graphic, an image, and an action taken by the computer-generated player concurrent with an introduction of the computer-generated player.

20. A method of conducting a wagering game on a gaming machine, the method comprising:

displaying a plurality of player-selectable elements each of which masks an associated outcome, one of the outcomes being a start-computer-player outcome;

receiving player selections from the plurality of player selectable elements;

in response to the start-computer-player outcome being selected by the player, introducing a computer player;

receiving computer-player selections from the plurality of player-selectable elements;

in response to the start-computer-player outcome not being selected during the wagering game, awarding the player an award based on the player selections; and in response to the start-computer-player outcome being selected during the wagering game, awarding the player an award based on the player selections and the receiving computer-player selections.

* * * * *